US006000352A

United States Patent [19]

Porter et al.

[11] Patent Number: 6,000,352

[45] Date of Patent: Dec. 14, 1999

[54] METHOD AND APPARATUS FOR SEWING FABRIC PANELS

[75] Inventors: Michael R. Porter, Topsfield, Mass.; Steven Marcangelo, Derry, N.H.; Frank W. Laroe, Topsfield, Mass.

[73] Assignee: Porter Sewing Machines, Inc., Beverly, Mass.

[21] Appl. No.: 08/950,908

[22] Filed: Oct. 15, 1997

[51] Int. Cl.[6] ..... D05B 27/10; D05B 13/00; D05B 11/00

[52] U.S. Cl. ..... 112/470.12; 112/2.1; 112/322; 112/475.03

[58] Field of Search ..... 112/320, 322, 112/217, 2.1, 311, 150, 153, 470.28, 304, 470.31, 470.32, 475.02, 475.03, 475.07

[56] References Cited

U.S. PATENT DOCUMENTS

| | | | |
|---|---|---|---|
| 1,947,058 | 2/1934 | Pittoni . | |
| 3,013,513 | 12/1961 | Judelson . | |
| 3,641,954 | 2/1972 | Kalning et al. | 112/2.1 |
| 4,013,026 | 3/1977 | Hall | 112/153 |
| 4,043,282 | 8/1977 | Fanghanel . | |
| 4,067,269 | 1/1978 | Fanghanel . | |
| 4,141,304 | 2/1979 | Masuda . | |
| 4,290,376 | 9/1981 | Brusasca et al. | 112/322 X |
| 4,498,404 | 2/1985 | Sadeh . | |
| 4,691,651 | 9/1987 | Junemann . | |
| 4,703,706 | 11/1987 | Plante | 112/470.31 |
| 4,742,789 | 5/1988 | Pestel et al. . | |
| 4,776,579 | 10/1988 | Romand et al. . | |
| 4,794,873 | 1/1989 | Dordii et al. . | |
| 4,813,364 | 3/1989 | Boser . | |
| 4,821,656 | 4/1989 | Dordii et al. . | |
| 4,825,787 | 5/1989 | Babson et al. . | |
| 4,827,856 | 5/1989 | Rohr . | |
| 4,838,186 | 6/1989 | Resta et al. . | |
| 4,905,615 | 3/1990 | Pofferi . | |

FOREIGN PATENT DOCUMENTS

| | | |
|---|---|---|
| 220368 | 5/1986 | European Pat. Off. . |
| 264618 | 9/1987 | European Pat. Off. . |
| 330285 | 2/1989 | European Pat. Off. . |
| 1567893 | 9/1967 | France . |
| 3139426 | 4/1983 | Germany . |
| 3712493 | 11/1987 | Germany . |
| 308465 | 11/1995 | Japan . |
| 1384073 | 2/1975 | United Kingdom . |
| WO 92/12282 | 7/1992 | WIPO . |
| WO 95/25194 | 9/1995 | WIPO . |

OTHER PUBLICATIONS

Yamaichi, Tape Binding & Sewing Robot System, Future Focus.

(List continued on next page.)

*Primary Examiner*—Ismael Izaguirre
*Attorney, Agent, or Firm*—Wolf, Greenfield & Sacks, P.C.

[57] ABSTRACT

A method and apparatus for sewing flange material to a fabric panel, preferably the top or bottom panel of a mattress sack. The apparatus includes a sled which pulls the fabric panel to and through the sewing machine. The apparatus also includes an edge guide that guides one edge of the panel to the sewing machine as well as provides a thickness measurement of the panel and smooths the fabric panel prior to sewing. The apparatus also includes a moveable dolly which carries the sewing machine find the flange material, and a wheel which engages the fabric panel during movement of the sewing machine away from the fabric panel to prevent movement of the fabric panel. The apparatus also includes apparatus for automatically removing the fabric panel from the table after completion of the sewing operation, as well as a cutter for cutting the trailing flange material and the sewing threads. The method of this invention includes the steps of sewing each edge sequentially, rotating the parcel around the corners while cutting and sewing the corners, and measuring the thickness of the panel to space the rotating arm from the table a specified distance less than the thickness of the panel. The method also includes the steps of adjusting the speed of rotation of the edge flattened to produce a flattened corner without wrinkles or ridges.

31 Claims, 13 Drawing Sheets

U.S. PATENT DOCUMENTS

| | | | |
|---|---|---|---|
| 4,958,579 | 9/1990 | De Weers . | |
| 4,998,965 | 3/1991 | Easom | 112/470.31 X |
| 5,282,433 | 2/1994 | Freermann et al. | 112/153 |
| 5,289,788 | 3/1994 | Fukumoto . | |
| 5,341,755 | 8/1994 | Kawasaki | 112/322 X |
| 5,367,968 | 11/1994 | Diaz . | |
| 5,529,004 | 6/1996 | Porter et al. . | |
| 5,560,308 | 10/1996 | Eto . | |
| 5,586,511 | 12/1996 | Porter et al. | 112/2.1 |

METHOD AND APPARATUS FOR SEWING FABRIC PANELS

FIELD OF THE INVENTION

This invention relates to a method and apparatus for manipulating and sewing flexible fabric panels, and more particularly to a method and apparatus for sewing flange material to the edges of panels of mattress sacks.

BACKGROUND OF THE INVENTION

Mattresses typically include an inner construction covered by a mattress sack. The mattress sack generally includes top and bottom panels which are interconnected by side panels. The sack usually is secured to the inner construction by a flange which is secured to the periphery of one of the top and bottom panels and which is connected to the inner construction using hog rings or the like. The inner construction typically includes springs of known configurations. The top and bottom panels may be sewn directly to the side panel, or joined with border tape or the like.

The flange material is usually affixed to the edges of a top or bottom panel at the same time as the edges of the panel are cut and stitched. This process utilizes a sewing machine adjacent a table upon which the mattress panel rests. While in the past, this process was primarily a manual operation, efforts have been made in more recent times to automate this process. Early attempts held the mattress panel stationary while propelling the sewing machine around the circumference of the mattress panel. More recent efforts in this regard have held the sewing machine stationary while manipulating the mattress panel on an air table. Examples of such apparatus are found in U.S. Pat. Nos. 5,529,004 (assigned to the Assignee of the present application), Publication No. W095/25194 (assigned to the Assignee of the present application), U.S. Pat. No. 5,560,308 and U.S. Pat. No. 5,367,968.

Problems encountered in all of these systems, and partially solved in some of the foregoing patents, include proper alignment of the edge of the mattress panel with the sewing needle, and proper rotation of the mattress panel around a corner to produce a rounded, evenly cut corner with the desired radius and stitching, and proper alignment of the flange material.

It is highly desirable to automate as much of the process as possible and to minimize the amount of manual labor required for sewing the mattress panels. Automation saves labor costs and minimizes injury to workers, produces a higher level of accuracy and provides reproducibility to render a more uniform look to the finished product.

Despite efforts to improve accuracy and to minimize worker participation, there is still room for improvement in both areas. In particular, some of the foregoing existing apparatus still require manual guidance of the sewn edge of the panel as it passes through the sewing machine, particularly at the end of the sewing cycle. In addition, the foregoing existing apparatus still require that the panel be manually removed from the table or sewing area at the end of the stitching cycle.

Therefore, it is one object of the present invention to more fully automate the process of stitching the edges of a mattress panel and attaching the flange.

It is another object of the present invention to further increase the accuracy and reproducibility of the stitching of the edges of the top and bottom panels of a mattress sack, and the attachment of the flange.

SUMMARY OF THE INVENTION

These and other objects are achieved in accordance with the present invention which relates to a method and apparatus for manipulating and sewing edges of fabric panels, such as the top or bottom panel of a mattress sack. This invention also relates to a method and apparatus for attaching a flange to the edges of a mattress panel. A conventional sewing machine and a conventional air table for supporting the fabric panel are employed.

One aspect of this invention is an improved edge guide which not only aligns and guides the edge of the panel as it is fed to the sewing machine, but also assists in preventing the panel from bunching up or folding over or expanding along the edge to prevent it from being too thick to be fed through the sewing mechanism of the sewing machine and to permit accurate location of the trailing edge. The edge guide includes top and bottom plates. The top plate drops down until it engages the top surface of the panel, and then backs off a predetermined distance to allow smooth feeding of the panel through the edge guide to the sewing apparatus. This operation also provides information to the controller on the vertical thickness of the panel. The edge guide also includes sensors that trigger the slow-down of the sewing machine and rotation of the panel about a corner.

In another aspect of the invention, a wheel is provided which drops down and engages the panel as the final edge is being sewn. The wheel can either be an idler wheel which freely rotates or it can be driven. If an idler wheel is provided, the wheel is disposed so that it rotates in a direction parallel to the feed direction about an axis perpendicular to the feed direction. In one embodiment, as the sewing machine is backed away from the panel along the final edge, the idler wheel prevents the panel from being pulled along with the machine in a direction transverse to the feed direction. In another embodiment, the wheel may be powered and disposed at a slight angle with respect to the feed direction to push the panel away from the sewing machine along the final edge of the panel.

In yet another aspect of the invention, apparatus is provided to remove the panel from the table after the sewing operation is completed. This apparatus includes an arm which is oriented generally parallel to the feed direction and which includes a plurality of wheels rotating about an axis generally parallel to the feed direction. When the wheels are pivoted into position so that they engage a fabric panel, the fabric panel is driven in a direction generally transverse of the feed direction off the table.

In a further aspect of the invention, an edge flattener is provided which is driven by a servo motor at varying speeds. The speed of the edge flattener is increased as the panel is rotated around a corner to feed the top layer faster at the corner to prevent bunching. Moreover, the desired rotation rate of the flattener can be set by the operator to produce optimal feed and flattening.

In another further aspect of the invention, when the apparatus of this invention is used to attach a flange to the edge of a top or bottom panel of a mattress sack, a flange guidance system is provided on a dolly which supports the sewing machine and which is movable with the sewing machine toward and away from the sewing table. A reel of the flange material is rotatably mounted the dolly. The flange material extends from the roll upwardly through a flange guide and out a slot at the top of the guide to be precisely aligned so that an outside edge of the flange material is disposed between the sewing needle and the edge cutter on the sewing machine. Moreover, since the flange material and guide are mounted on the moveable dolly carrying the sewing machine, as the final edge of a panel is sewn and the sewing machine is retracted away from the table, the flange material also is retracted from the panel. A cutting wheel mounted on a pneumatically actuated arm cuts the flange material and sewing threads after completion of the sewing process.

Another aspect of the present invention includes an elongated sled utilized to pull the panel through the sewing zone of the sewing machine. This sled extends generally transversely of the feed direction of the panel and is sufficiently long to extend substantially across the width of the panel being pulled. The sled includes at least two clamps for grasping a forward edge of the panel at two different points. A slip clutch allows the sled to maintain tension on the panel without ripping the panel, and without pulling the panel through the sewing zone faster than the feed mechanism of the sewing machine will allow.

In accordance with the forgoing apparatus, an improved method is also disclosed for sewing flange material to the top or bottom panel of a mattress sack and for sewing and cutting the edge of the panel. In this improved method, operator participation is minimized. The operator manually places a panel onto the table so that a forward edge is adjacent the clamps of the sled in its home position and so that a side edge is aligned with the edge guide. The automatic process is then commenced by the pressing of a button or the like. Both sled clamps close and the sled pulls the panel to a position in which the sewing head is a predetermined distance from the first corner. The edge guide measures the panel thickness and then is backed away from the table and away from the panel, while the sewing head of the sewing machine is advanced towards the panel into a sew position. The clamp spaced farthest from the sewing machine then opens. The operator manually loads the panel into the sewing machine. Thereafter, automatic sewing is commenced by the activation of another button or the like on the control panel. The edge guide is then advanced toward the panel into the desired orientation, and the top plate of the edge guide drops down to its programmed spacing from the bottom plate. The sewing machine then stitches a predetermined distance, for example 6", to determine the stitch rate for this particular panel. Thereafter, the panel is sewn and cut until the corner is reached. Flange material is fed to the sewing machine and stitched to the panel edge. The panel is pivoted at the corner and stitched and cut while the panel is pivoted to produce a rounded corner.

After four edges are sewn and cut in a similar manner, the panel returns to its initial edge after it rounds the fourth corner. A wheel then drops down to engage the top surface of the panel. In one embodiment, the wheel is free-wheeling and rotates in a direction generally parallel to the feed direction about an axis perpendicular to the feed direction. As the start location is approached along the initial edge, the sewing machine backs away from the panel to taper the amount of material cut from the edge so as to blend the newly cut edge with the originally cut and sewn edge. In another embodiment, the wheel is angled with respect to the feed direction, and rotates at an angle away from the sewing machine. In this embodiment, the sewing machine remains stationary and the wheel begins pushing the panel away from the sewing machine until the panel is completely removed from the sewing machine at the start point. In either embodiment, the flange material stays aligned with the sewing machine and the sewing machine sews off onto the flange material. Thereafter, the flange material is cut and the panel is carried by the sleds to an unload point. The unload apparatus then propels the panel off the table.

The foregoing method and apparatus substantially fully automate the process of affixing flange material to a top or bottom panel of a mattress sack. In addition, a precisely and reproducibly cut and sewn edge is provided all the way around the perimeter of the panel. Rounded corners are also produced.

BRIEF DESCRIPTION OF THE DRAWINGS

The invention will be more fully appreciated from the following detailed description when taken in conjunction with the accompanying drawings, in which.

DETAILED DESCRIPTION OF THE INVENTION

The present invention relates to a method and apparatus for manipulating and sewing a panel formed of a flexible material, such as a top panel or bottom panel of a mattress sack. This method and apparatus may also be used to attach a flange to the edges of a mattress panel. This invention permits a high level of automated manipulating and sewing and minimizes the need for human intervention. This system includes improvements to that described in publication WO 95/25194, and U.S. application Ser. No. 08/656,345, assigned to the Assignee of the present application, each of which is specifically incorporated herein by reference.

Figure 1A:
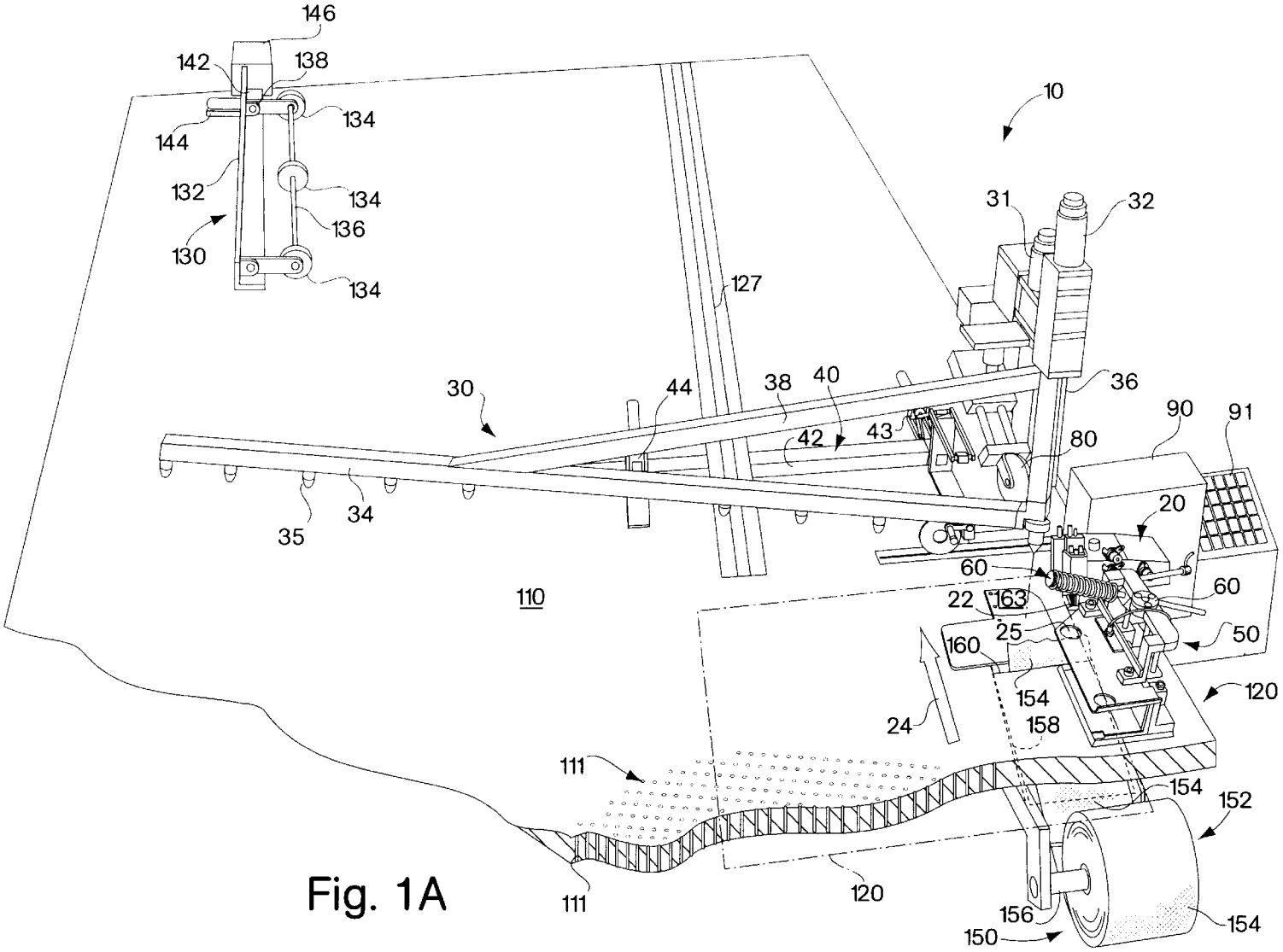
FIG. 1A is a top, perspective view of the apparatus of this invention.
Figure 1B:
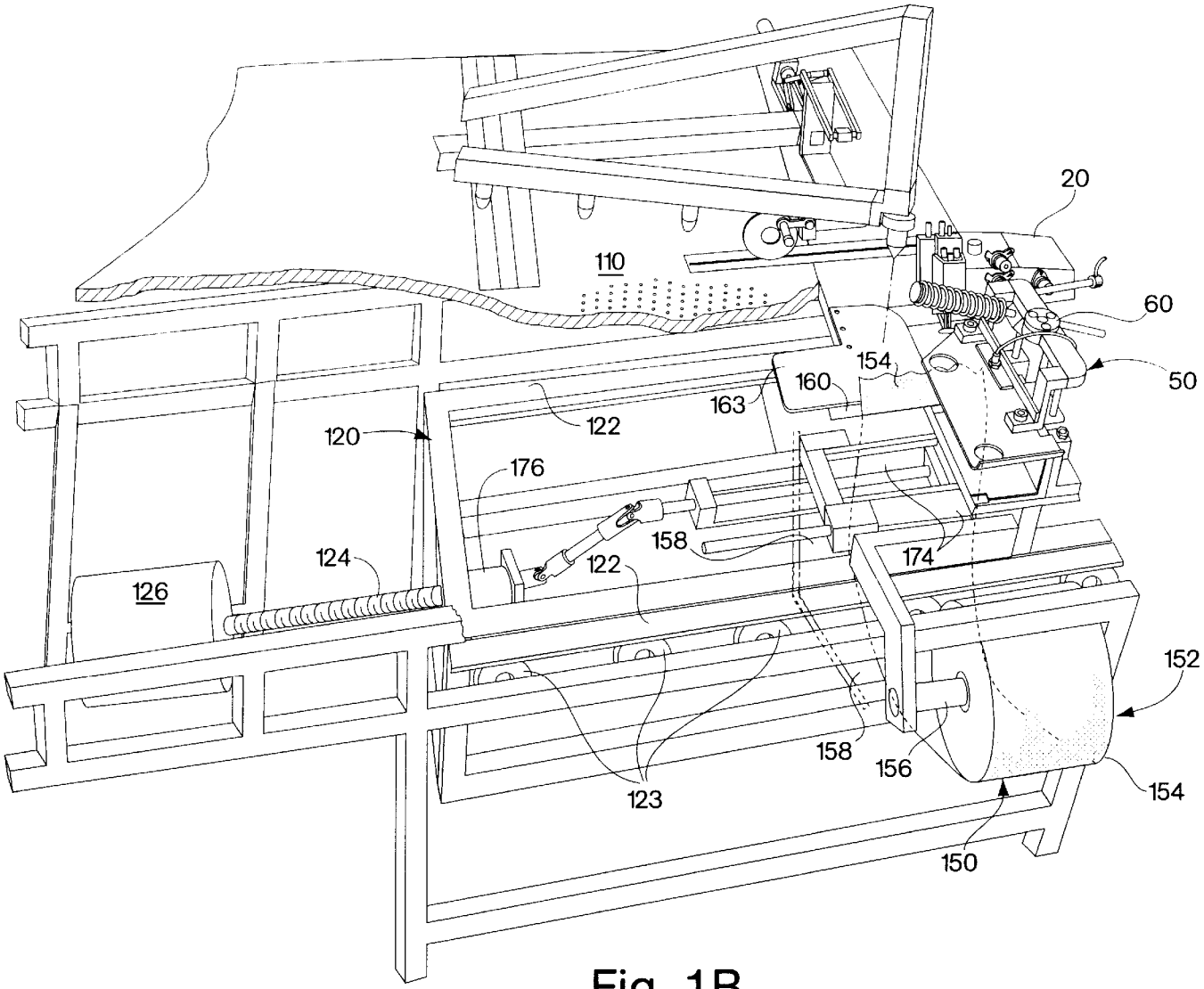
FIG. 1B is a top, partially cutaway perspective view of the apparatus of FIG. 1A.
Figure 1C:
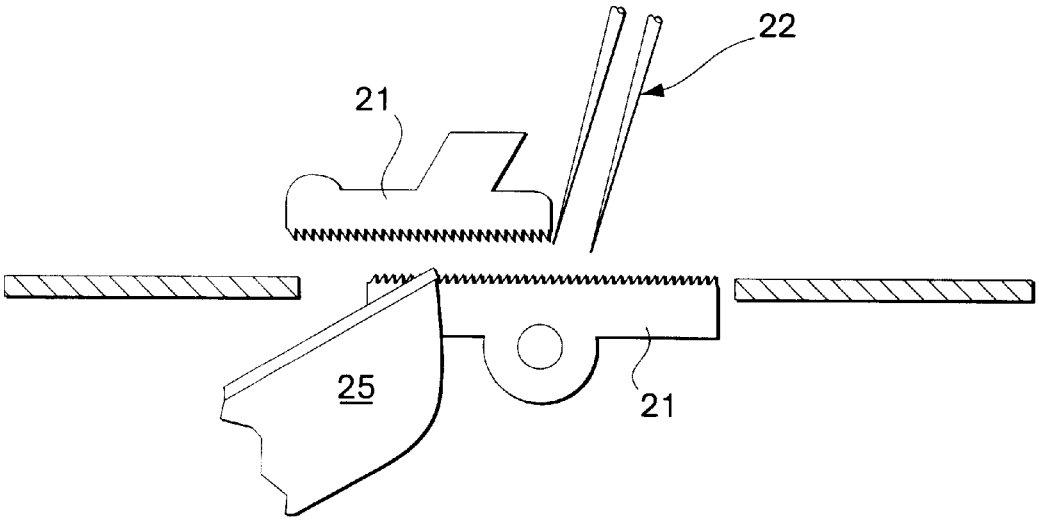
FIG. 1C is a side, schematic view of the sewing elements of the sewing machine of FIG. 1A.

One embodiment of the method and apparatus of the present invention will now be described with particular reference to FIGS. 1A–1C. Apparatus 10 includes sewing machine 20, pivot arm 30, sled 40, edge guide 50, edge flattener 60, cutter 70 (FIG. 7), wheel 80, dolly 120 and flange guidance system 150. Fabric panels 100 (FIG. 8) or the like are supported by and manipulated on a work table 110 such as a conventional air table which includes a plurality of small holes 111 through which compressed air is forced.

The operation of all of the components of apparatus 10 is controlled by controller 90 which is a programmable microprocessor or the like and is conventional in nature. Controller 90 sends appropriate signals to each of the components to perform their desired function at the desired time, and coordinates the supply of pneumatic pressure where required to allow components to perform desired operations. A typical example of controller 90 is a microprocessor sold by Control Technology Corp. Controller 90 includes either a central panel or a conventional touch screen 91.

Sewing machine 20 is conventional, and may be, for example, a machine such as the Porter 1000 or Porter 518, sold by Porter Sewing Machines, Inc. of Beverly, Mass. Sewing machine 20 includes the usual feed dogs and/or walking feet 21 for feeding a work piece to a conventional stitching needle or needles 22 in a feed direction identified in FIG. 1A by arrow 24. If two needles 22 are provided, one needle typically produces an overedge stitch while the other needle produces a chain stitch. The needle disposed most closely adjacent the outer edge of the fabric produces the overedge stitch. Machine 20 also includes a conventional edge cutter 25 for cutting a strip of material from the edge of a panel 100 (FIG. 8) as it is being sewn. A preferred sewing machine 20 includes a Wilcox and Gibbs-type cutter 25 which cuts material in the feed direction 24 as the material is being stitched and moved in feed direction 24. Cutter 25 moves up and down in synchronization with needles 22 of sewing machine 20. As such, cutter 25 permits cutting of the edges of the panel to provide rounded corners and smooth edges.

Sewing machine 20 is carried by a moveable dolly 120 which rides on rails 122 which are oriented in a direction generally perpendicular to the feed direction 24. Rails 122 rest on rollers 123. Dolly 120 is moved toward and away from table 110 in a direction generally perpendicular to the feed direction 24 by a drive such as a conventional screw drive 124 which is operated by a servo motor 126 and controlled by controller 90. Drive 124 may, for example, include a threaded screw shaft which rotates and extends through a mating, stationary threaded block (not shown) which is affixed to dolly 120. Typically, dolly 120 has a range of travel of about 6", although the range of travel could be any amount desired. Servo motor 126 locks dolly 120 into a desired position. The location of dolly 120 may be monitored by a conventional position sensor or shaft encoder (not shown).

Pivot arm 30 rotates a fabric panel 100 around a corner during the stitching operation. Arm 30 is pivoted by motor 31. Pivot arm 30 is raised and lowered by stepper motor 32 in response to commands received from controller 90. Arm 30 includes a generally horizontal beam 34, generally vertical post 36 and a connecting leg 38 which extends from the top of post 36 to beam 34. Disposed on the lower surface of beam 34 are projections 35 which preferably have pointed tips and are somewhat resilient. Rubber is a preferred material for projections 35, although other materials could be used which would not tear panels 100. Projections 35 are designed to engage the upper surface of a fabric panel 100 for rotation thereof. Pivot point 37 is disposed on the bottom end of post 36. Point 37 rests on a panel 100 on table 110 when lowered by motor 32 and provides a point about which arm 30 rotates. Point 37 is formed of the same material as projections 35. When rotating a panel 100, projections 35 and point 37 are spaced a small distance above table 110 to prevent damage to panel 100. Typically, projections 35 and point 37 are positioned one half the thickness of a panel above table 110. This distance was previously calculated by edge guide 50, as will be discussed.

Sled 40 includes an arm 42 that extends in a direction generally transverse to the feed direction 24. Mounted on arm 42 are at least two clamps 43 and 44. Clamp 43 is spaced from the sewing machine 20 downstream of or after the sewing machine 20 in the feed direction 24. Clamp 43 also is generally aligned with the sewing needles 22 in a direction transverse to the feed direction 24, although clamp 43 may also be offset from the sewing needles 22 toward clamp 44 in a direction transverse to the feed direction 24. Clamp 44 is spaced from clamp 43 in a direction transverse to the feed direction 24. Clamps 43 and 44 are spaced sufficiently to provide a stable pull on a panel 100 along a forward edge 102, yet are not spaced so far that clamp 44 is disposed beyond the other side edge 107 of a panel 100.

Clamps 43 and 44 are preferably the same and are preferably pneumatically actuated, although they need not be. Clamps 43 and 44 each include a lower plate 45 and an upper, pivotally mounted clamp arm 46. Each arm 46 is operated by an associated pneumatic cylinder 47. Plates 45 travel or slide along table 10 and are sufficiently thin that they each slide between a panel 100 and table 110, preferably without producing any movement of panel I 00. In operation, a signal from controller 90 actuates cylinder 47 to drive clamp arm 46 downwardly to clamp an edge of panel 100 between clamp arm 46 and lower plate 45.

Figure 6:
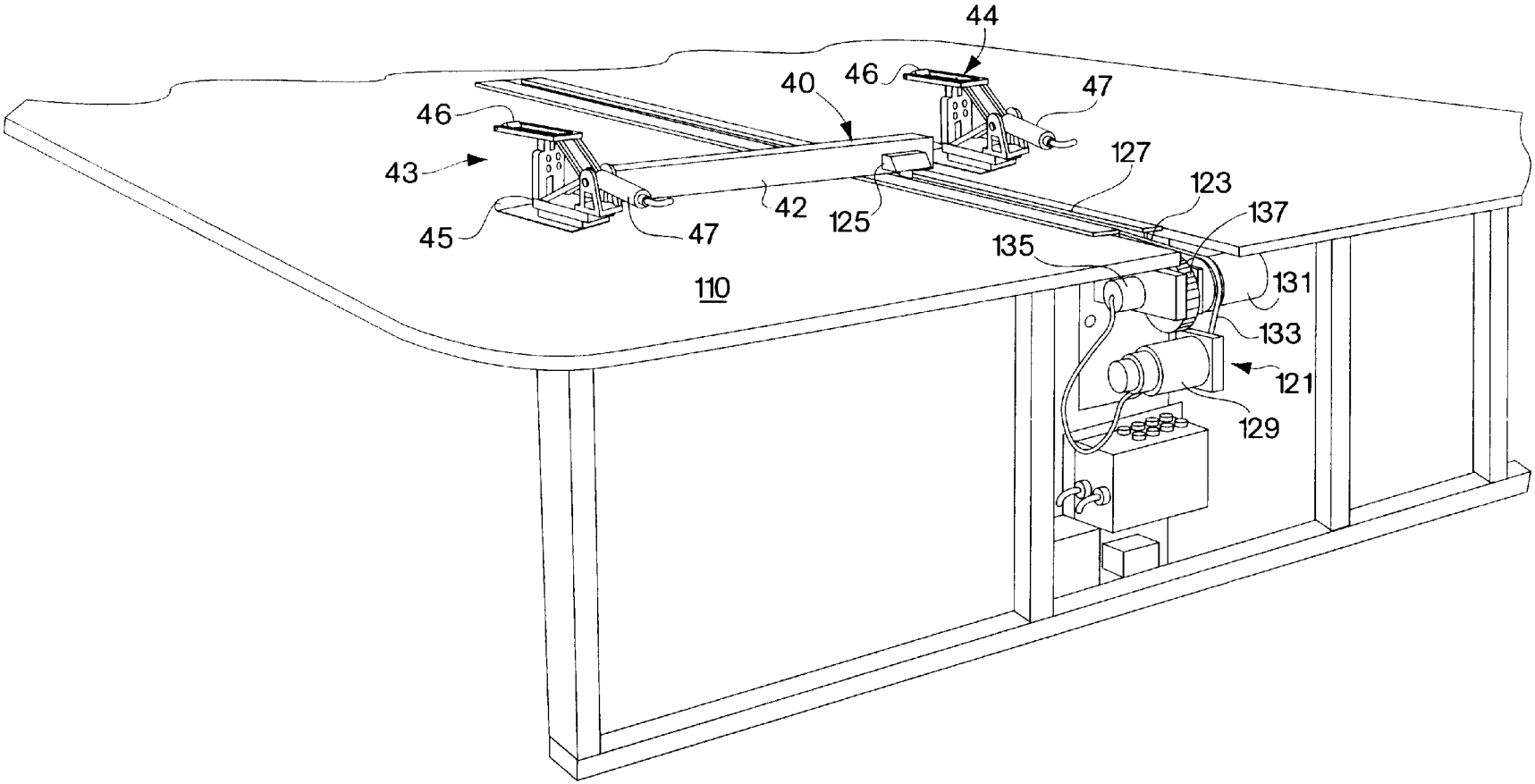
FIG. 6 is a partial, side perspective view illustrating the sled and driving system therefor of the apparatus of FIG. 1A.

Arm 42 and associated clamps 43 and 44 arc driven along table 10 by a drive system 121, as shown in FIG. 6. Drive system 121 may be any conventional belt drive and includes a belt 123 formed of a chain or a flexible rubber or plastic material which is affixed to arm 42 by fixture 125. Fixture 125 extends up through a slot 127 disposed on the surface of table 110. Belt 123 is driven by servo motor 129 which responds to signals received from controller 90. A slip clutch 131 is disposed in the drive train between motor 129 and belt 123. Slip clutch 130 may be, for example, a pneumatic pressure clutch which allows slippage of motor 128 with respect to belt 123 and provides an upper limit to the force applied to the forward edge 102 of fabric panel 100. Slip clutch 131 allows sled 40 to apply tension to panel 100 along edge 102 without tearing panel 100 or without overriding the feed mechanism of sewing machine 20. As a result, sled 40 moves only as fast as sewing machine 20 will allow. Typically, clutch 131 is coupled to motor 129 by a belt 133, although other known connections may be used. Preferably clutch 130 is connected to belt 123 by means of a pulley 137, although a gear chain or other known connections may be used.

A known shaft encoder 135 tracks the position of sled 40 in a known manner. Shaft encoder 135 is a slave shaft encoder coupled to the shaft of clutch 131, such as by a belt (not shown). The belt coupling the shaft encoder to the clutch 131 moves only when and as much as belt 123 and thus precisely tracks the location of sled 40.

Pneumatic lines (not shown) couple both cylinders 47 to a source of compressed air and extend along belt 122. Preferably, a known mechanism is provided for gathering the pneumatic lines and for providing a flexible casing for allowing the lines to pay out with movement of sled 40 and for preventing the pneumatic lines from becoming entangled in the sled. A typical mechanism is an articulated, semi-rigid chain through which the pneumatic lines pass. Such a chain is sold by Igus Company of Rhode Island under the trademark NYLATRAK.

Figure 3:
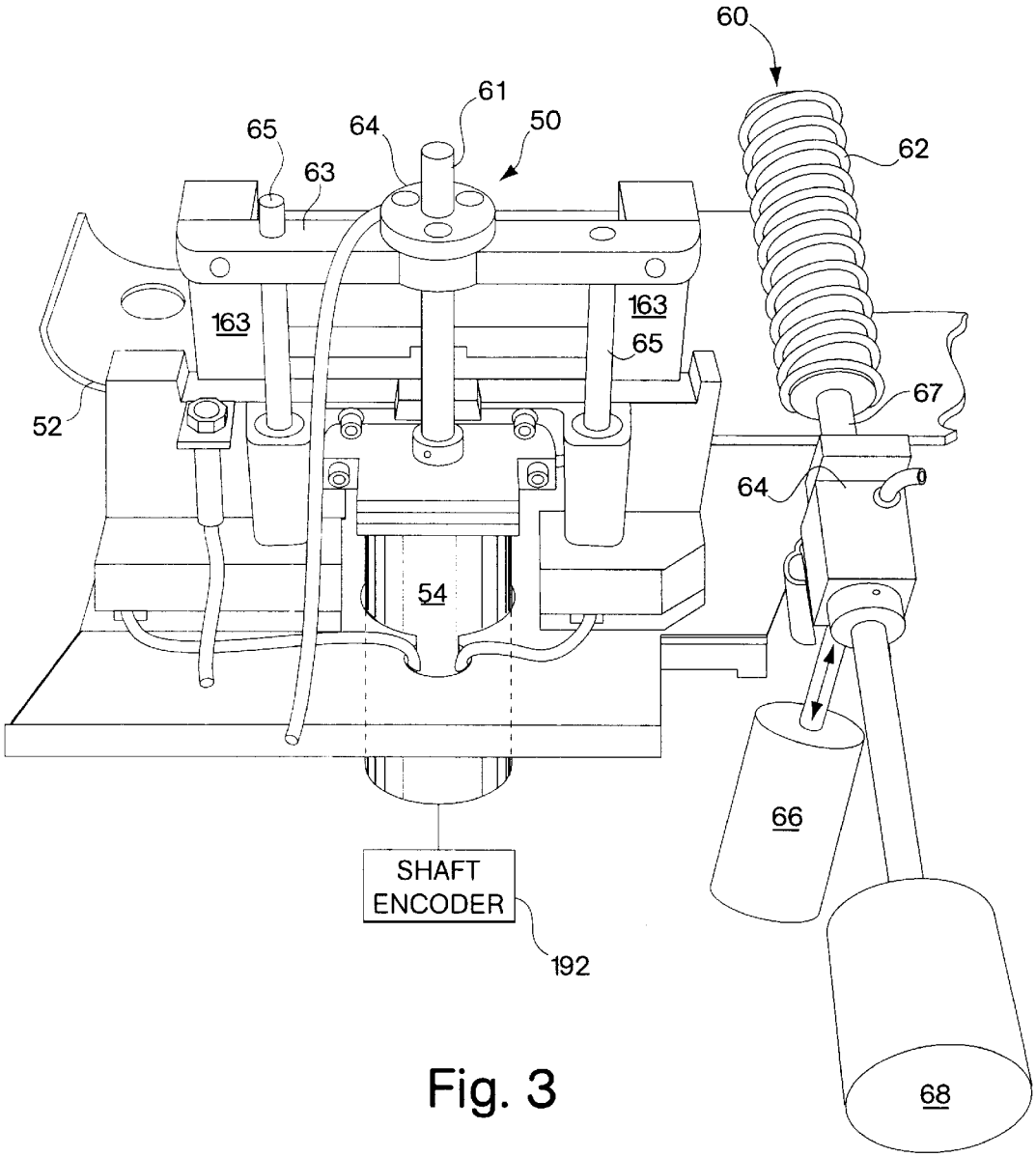
FIG. 3 is a partial, side perspective view illustrating the edge guide of the apparatus of FIG. 1A.

Edge flattener 60 will now be described with reference to FIGS. 1A and 3. Flattener 60 is designed to flatten an edge of a panel 100 before the edge is sewn by sewing machine 20. Moreover, edge flattener 60 urges any protruding fill outwardly towards the edge of the panel. Edge flattener 60 is disposed prior to the sewing needles 22 in the feed direction 24. A preferred edge flattener includes a central shaft 67 and a helical ridge 62 disposed on the outer surface of shaft 67. Shaft 67 of flattener 60 is pivotally mounted and uses a spring mount 64 to absorb vibrations. A pneumatic cylinder 66 raises the flattener 60 upwardly off table 110 during loading of a panel 100. Alternatively, the cylinder 66 may be used to replace the spring mount by acting as an air spring. Flattener 60 is held against an upper surface of a panel 100 by mount 64 and/or cylinder 66. While shaft 67 of flattener 60 may be attached to the main drive shaft of the sewing machine 20 with a flexible drive (not shown) so that it may sychronously rotate with the sewing machine, preferably flattener 60 is rotated by a separate dedicated servo motor 68 controlled by controller 90. Flattener 60 is rotated about its central axis preferably in a direction counter to the feeding direction 24 of the materials. In other words, the bottom surface of flattener 60 engaging the top surface of panel 100 moves in a direction opposite of feed direction 24. Servo motor 68 allows the edge flattener to be rotated at a speed which varies under different operating conditions. This feature is particularly valuable when rotating a panel around its corner, since the speed of the edge flattener preferably is increased to accommodate a somewhat increased speed of movement of the sewing surface of panel 100 as the panel is being rotated to prevent the formation of radially extending wrinkles or an undulating surface at the corners.

Figure 7:
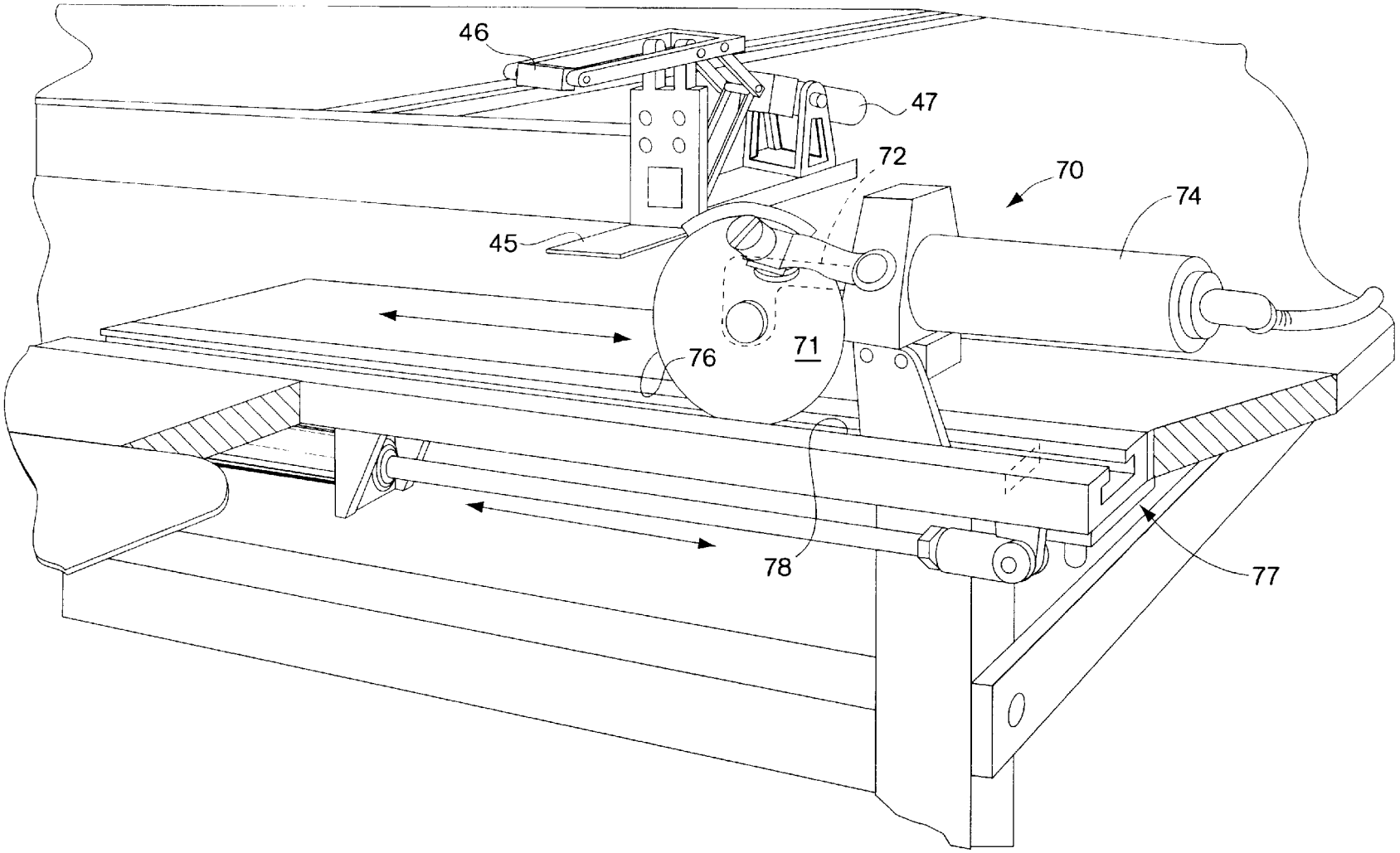
FIG. 7 is a partial, side perspective view illustrating the flange cutter of the apparatus of FIG. 1A.

Cutter 70 will now be described with particular reference to FIG. 7. Cutter 70 includes a wheel 71 rotatably mounted on the distal end of an arm 72 which is extended and retracted by a pneumatic cylinder 74. Wheel 71 includes a sharpened edge 76 around its perimeter which is adapted to cut fabric material. Edge 76 rides in recessed slot 77 on table 110 and on cutting surface 78 within slot 77. Cylinder 74 propels arm 72 and wheel 71 in a direction transverse to the feed direction 24 and is controlled by controller 90. Wheel 71 is typically used to automatically cut flange material and the sewing thread along trailing edge 104 of a fabric panel 100 after completion of a sewing operation attaching flange material to the edges of a fabric panel 100. FIG. 7 shows wheel 71 in its nested position adjacent cylinder 74. Upon completion of a sewing operation, and upon receiving a command from controller 90, arm 72 propels wheel 71 to the left as shown in FIG. 7 and returns it to nested position in FIG. 7 after completion of a cutting operation.

Figure 2:
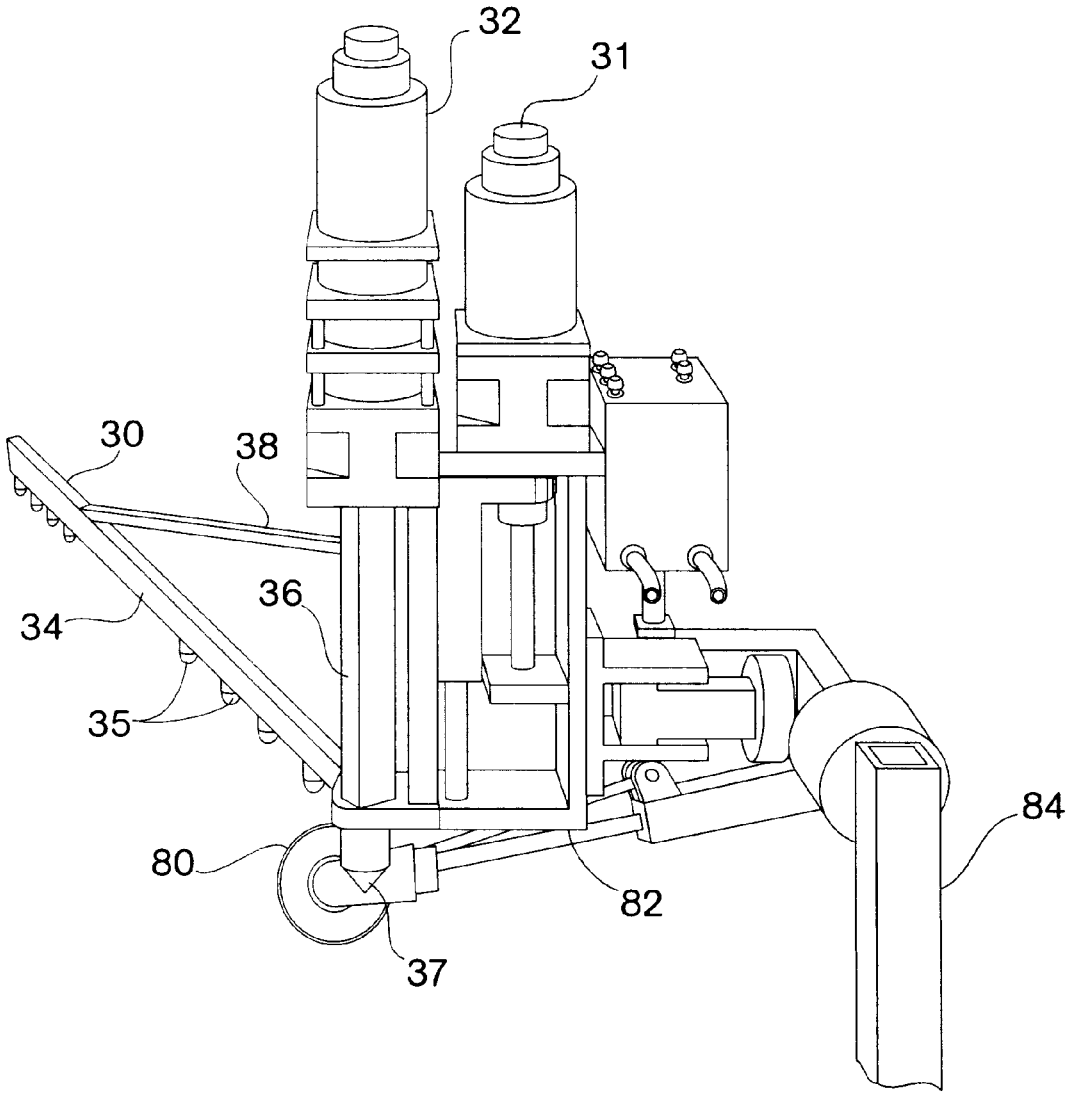
FIG. 2 is a partial, side perspective view of the apparatus of FIG. 1A.

Wheel 80 will now be described with particular reference to FIG. 2. Wheel 80 is rotatably mounted at the end of an extensible arm 82. Arm 82 is pivotally mounted at its opposite end to a support structure 84. Arm 82 may be extended by operation of a pneumatic cylinder (not shown). Pivoting of arm 82 about support 84 is also accomplished through the use of a pneumatic cylinder (not shown). Both the pivoting of arm 82 and its extension are controlled by controller 90. Preferably, wheel 80 is an idler wheel, and is allowed to rotate freely about its central axis. Typically wheel 80 is actuated at the conclusion of a sewing operation on a panel and is pivoted downwardly at the same time as arm 82 is extended outwardly to place wheel 80 in contact with the top surface of a panel 100. Wheel 80 is designed to permit panel 100 to pass beneath it in the feed direction 24, and therefore is aligned such that it rotates freely about an axis that is generally transverse to the feed direction 24. Wheel 80 prevents panel 100 from moving in a direction transverse to the feed direction as sewing machine 20 is withdrawn from the edge 106 of panel 100, or away from table 110 during the final stages of a sewing operation, as will be described.

Alternatively, wheel 80 may be coupled to a servo motor (not shown) and positively driven. If positively driven, wheel 80 is disposed such that its axis of rotation forms an acute angle with respect to a line transverse to the feed direction 24. In this configuration, when wheel 80 is rotated wheel 80 pushes panel 100 generally in feed direction 24 but away from sewing machine 20 at an acute angle with respect to the feed direction. This feature allows panel 100 to be pushed away from the sewing machine while the sewing machine remains stationary with respect to table 110 at the end of a sewing operation, thus also allowing the panel to be completed without continuing to cut the panel edge beyond the starting point of the sewing operation.

Figure 4:
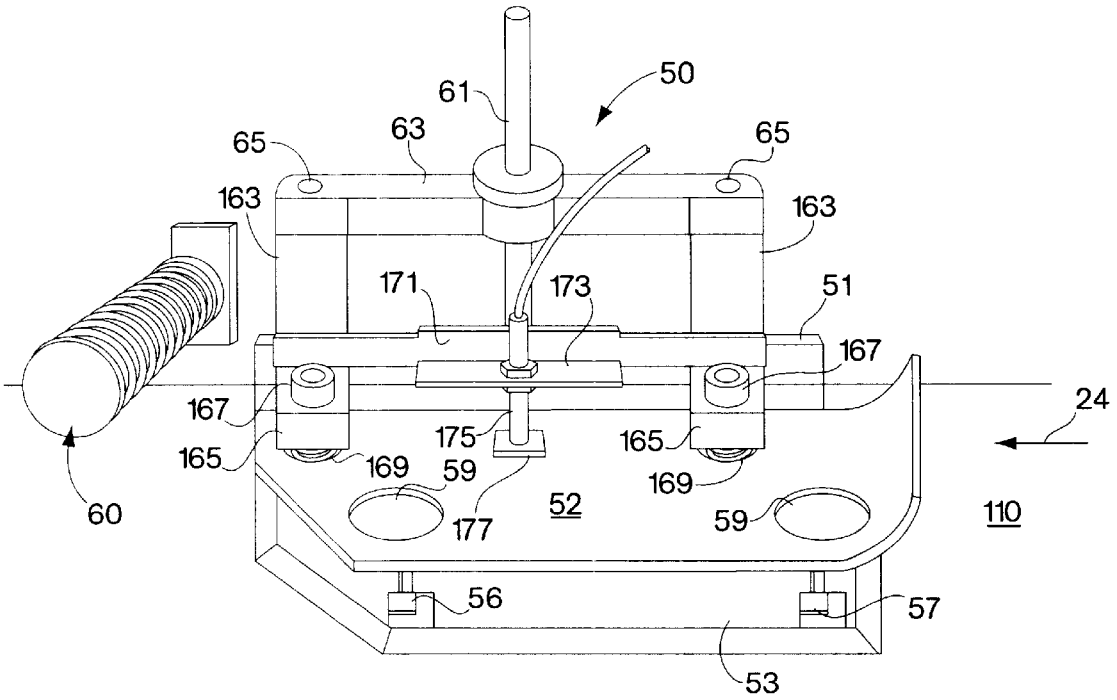
FIG. 4 is a partial, side perspective view illustrating one operating position of the edge guide of FIG. 3.
Figure 5:
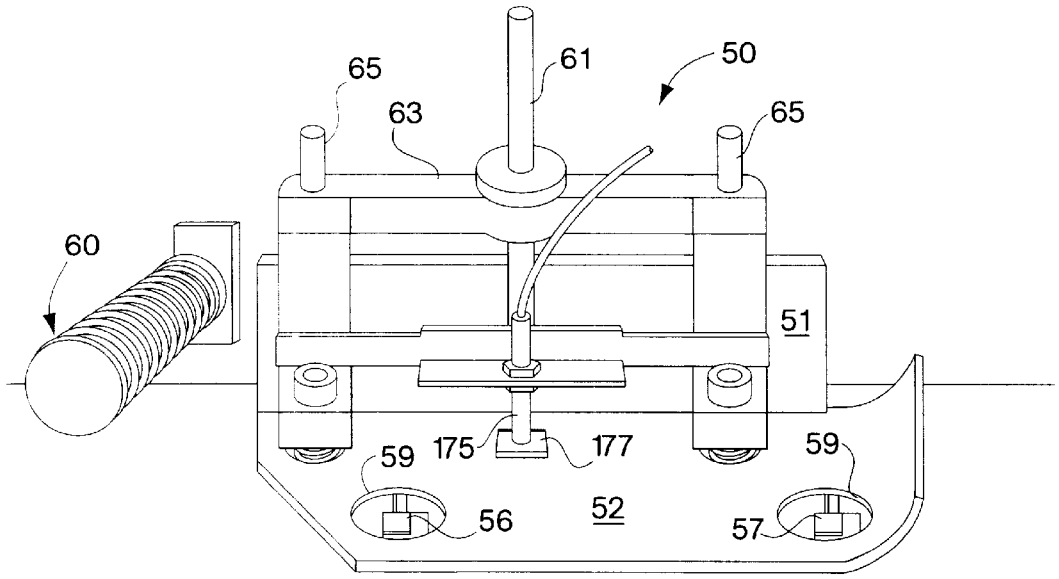
FIG. 5 is a partial, side perspective view illustrating another operating position of the edge guide of FIG. 3.

Edge guide 50 will now be described with particular reference to FIGS. 3, 4 and 5. Edge guide 50 serves three functions. First, edge guide 50 provides guidance to the inside edge 106 of a panel 100 being sewn to properly align it with sewing machine 20. The second function is to sense the position of the trailing edge 104 of a panel 100. The third function is to determine the thickness of the panel and to prevent the panel from rising up off the surface of table 110 or folding over onto itself prior to sewing. Such a folded or rising panel could impede the sewing process, provide an undesirable stitch, or cause an inaccurate determination of the location of trailing edge 104 of panel 100.

Edge guide 50 includes an upper plate 52 having a generally horizontal lower surface, a lower plate 53 having a generally horizontal upper surface parallel to the lower surface of plate 52 and a generally vertical back registration plate surface 51 which is perpendicular to the lower surface of plate 52 and the upper surface of 53. The edge of plate 52 facing away from sewing machine 20 in the feed direction 24 is generally curved upwardly away from plate 53 to facilitate the advance of a panel 100 between plates 52 and 53.

Edge guide 50 also includes sensors 56 and 57. Sensors 56 and 57 detect the location of trailing edge 104. In a preferred embodiment, sensors 56 and 57 are each conventional diffused infrared sensors which emit infrared radiation from a dedicated emitter portion and receive reflected infrared radiation at a receiver portion. If a panel 100 is present, sensors 56 and 57 are covered by panel 100 and infrared radiation emitted by the emitter is reflected by the panel back to the receiver. If the panel does not cover the emitter, the infrared radiation escapes through openings 59 in plate 52 and is not returned to the receiver. A low intensity beam is preferred to provide a finer beam width to give a more accurate reading of the position of edge 104 since a low intensity beam is relatively unaffected by panel thickness. As trailing edge 104 passes sensor 57, no infrared radiation strikes sensor 57, controller 90 is signaled accordingly, and the speed of sewing machine 20 is reduced. As the trailing edge 104 passes sensor 56, the sewing machine stops, and the controller initiates the process of rotating panel 100 about a corner, which will be discussed in more detail hereinafter. Sensors 56 and 57 could also be conventional photocells which are receptive to light of other wavelengths, and which are designed to detect the absence or presence of light or the interruption of light.

Lower plate 53 preferably is vertically stationary, while upper plate 52 is movable vertically, or in a direction generally perpendicular to plate 53 toward and away from plate 53 by a servo motor 54. It is to be understood, however, that upper plate 52 could be stationary while lower plate 53 is movable in a direction perpendicular to upper plate 52, or that both plates 52 and 53 could be moveable with respect to one another in a direction generally perpendicular to their horizontal extent. Motor 54 rotates shaft 61 and includes a shaft encoder 192, or any other sensor capable of measuring the spacing between the lower surface of plate 52 and the upper surface of plate 53. One end of shaft 61 is attached to the rotor of motor 54 while the other end is rotatably mounted in non-rotating support 63 for upper plate 52. Preferably, nonrotatable support rods 65 are disposed on either side of shaft 61 to provide stability to support 63 and to provide smooth vertical movement of upper plate 52. Edge (guide 50 is mounted on horizontal rails 174 which allow a motor 176 with a conventional screw drive to move edge guide 50 toward and away from table 110.

Extending downwardly from generally horizontal support 63 are two generally vertical support posts 163. Extending outwardly away from each support post 163 and overlying upper plate 52 is a support arm 165. Each support arm 165 is coupled to plate 52 by a connector 167 which may be screw, rivet, bolt or the like. Disposed between the lower surface of each support arm 165 and an upper surface of plate 52 is a spring 169, or some other similar sort of biasing system. Typically, springs 169 are disposed about connectors 167. Springs 169 preferably are helical compression springs, foam, or the like. Disposed on a cross-support 171 which extends between posts 163 is a plate 173 upon which is mounted a proximity sensor 175. Disposed directly below sensor 175 on an upper surface of plate 52 is a pad 177. Sensor 175 is programmed to send a signal to controller 90 when it gets within a predetermined distance from pad 177, typically 1 to 1.5 mm.

In operation, as a panel 100 passes through edge (guide 50, the inner edge 106 of panel 100 is aligned in registration with back registration plate surface 51. Initially, controller 90 moves upper plate 52 downwardly toward the upper surface of panel 100 until the bottom of plate 52 encounters the upper surface of panel 100. Any further advance of plate 52 compresses springs 169 until proximity sensor 175 detects the presence of pad 177. Upon detection of pad 177, controller 90 backs upper plate 52 away form lower plate 53 a predetermined distance, such as ⅛ to ¼", to prevent plates 52 and 53 from providing an undesirable drag on the movement of panel 100. During this process, controller 90 measures the thickness of the panel 100. This measurement, and the movement of upper plate 52 away loom lower plate 53 is monitored and controlled by the shaft encoder 192. Plates 52 away 53 prevent a panel 100 from expanding vertically, or folding over onto itself which could foul the sewing process and also which could provide an inaccurate measurement of the position of the trailing edge 104 of the panel. Vertical expansion of the panel would shorten the length of panel 100 accordingly and could also unduly reflect infrared light back to sensor 56 or 57 after edge 104 had already passed. If properly flattened along edge 106, the position of trailing edge 104 is properly determined and the panel is smoothed out in preparation for sewing.

Flange guidance system 150 will now be described with particular reference to FIGS. 1A and 1B. System 150 includes a rotatable reel 152 which carries flange material 154 on a roll. Reel 152 is mounted on an axle 156 on dolly 120, and moves with dolly 120 toward and away from table 110. Reel 152 rotates about axle 156, or axle 156 is journalled at its ends in dolly 120. Axle 156 is oriented in a direction generally perpendicular to feed direction 24. System 150 includes a feed passage 158 which extends front adjacent reel 152 and to a slot 160 in a surface 163 parallel to table 110 and inserted into a recess in table 110. Surface 163 is mounted onto dolly 120. Slot 160 is disposed between edge guide 50 and sewing machine 20. Passage 158 and slot 160 are sufficiently wide to accommodate and guide typical flange material used in conjunction with a mattress panel. The outside edge of passage 158 and slot 160 facing away from table 110 is oriented such that an edge of flange material 154 exiting slot 160 in registration with the outer edge of slot 160 will pass through the sewing, machine 20 in precisely the desired location. Preferably, the outer edge of the flange material 154 passes between edge cutter 25 and needles 22 of the sewing machine 20 so that the flange material is sewn to the panel 100, but is not cut by cutter 25 during the sewing operation. As a result, after the cutting operation has been completed, the outer edge of the flange material 154 is roughly aligned with the cut edge of the finished panel 100. As dolly 120 is backed away from table 110, as will be described, the flange material 154 travels with dolly 120 to remain properly aligned at all lines with needles 22 and cutter 25 at the completion of the sewing operation. When withdrawn, sewing machine 20 sews off onto flange material 154, and cutter 70 cuts both the material 154 and the sewing threads.

Figure 8:
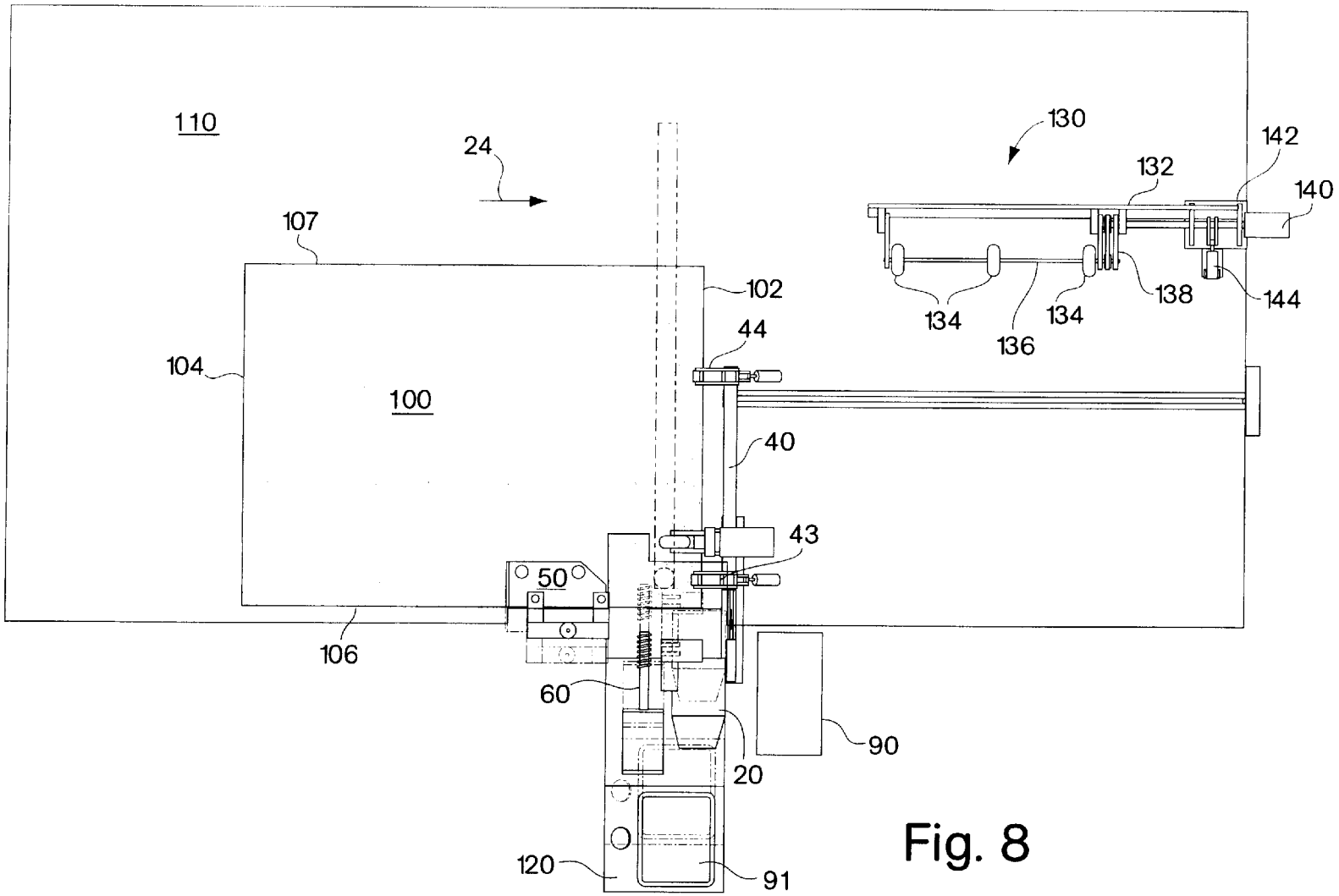
FIG. 8 is a top, schematic plan view of the apparatus of FIG. 1A illustrating an initial operating position.

Unload apparatus 130 will now be described with reference to FIG. 8. Apparatus 130 is mounted on table 110 at a position downstream or beyond sewing machine 20 in feed direction 24 and is also preferably, although not necessarily, spaced from sewing machine 20 in a direction perpendicular to the feed direction 24. Ideally, apparatus 130 is disposed such that after panel 100 is completely sewn and is pulled by sled 40 to a position where trailing edge 104 is roughly aligned with sewing machine 20, an outer edge 107 opposite inner edge 106 is disposed beneath apparatus 130.

Apparatus 130 includes a support arm 132 which preferably extends in a direction generally parallel to the feed direction 24. Arm 132 carries a plurality of wheels 134 which rotate about an axle 136 which typically extends generally parallel to the feed direction 24. Wheels 134 are driven by belts 138 which in turn are driven by motor 140. Arm 130 is spaced above table 110 a distance sufficient to allow a panel 100 to pass between arm 130 and table 110. Arm 130 is supported in this position by mount 142. Arm 130 typically is rotatably mounted in mount 142 such that arm 130 may pivot about an axis which extends along its direction of elongation in the feed direction 24 to either raise wheels 134 off table 110 or to rotate them downwardly toward table 110 and into engagement with an upper surface of panel 100. This rotation is controlled by a pneumatic cylinder 144 which in turn is controlled by controller 90.

In operation, at the appropriate time, cylinder 144 pivots arm 130 such that wheels 134 are urged downwardly into engagement with an upper surface of panel 100 when the panel has been fully sewn. At this point, wheels 134 are rotated in such a manner as to push panel 100 in a direction perpendicular to feed direction 24 off table 110 and away from sewing machine 20, as shown in FIG. 14.

A photocell sensor 190 (FIG. 12) or the like is positioned on table 110 at a predetermined distance from sewing machine 20 upstream thereof or before sewing machine 20 in the feed direction 24. A typical predetermined distance is 14". Sensor 190 detects when the trailing edge 104 of panel 100 passes and alerts controller 90, for reasons to be discussed. Sensor 190 typically is aligned with sensors 56 and 57 in a direction transverse to feed direction 24 but is spaced upstream of sensors 56 and 57 in the feed direction 24.

The operation of apparatus 10 and the method of this invention will now be described with particular reference to FIGS. 8–12.

The process is initiated by the manual placement of a panel 100 on table 110. At this point, the edge guide 50 is advanced toward table 110 in its normal sewing position and plates 52 and 53 are separated. Also, at this point, sled 40 is in its programmed home position, or in its position that is normally closest to sewing machine 20 in the feed direction 24, but downstream thereof as shown in FIG. 8. Clamps 43 and 44 are in their open position. Flange material 154 is either already present and properly aligned in sewing machine 20, or the operator has pulled a leading edge of the material off reel 152 and through passage 158. The operator places edge 106 of panel 100 in registration with edge 51 and edge 102 is aligned with clamps 43 and 44. The operator then activates a button, or a location on a touch screen. This initial button or location on a touch screen is called a "panel advance" button. Controller 90 responds by closing both clamps 43 and 44 to grasp forward edge 102 of panel 100. Controller 90 then prompts sled 40 to pull panel 100 until edge 104 is a predetermined distance away from needle 22, as detected by sensor 190 as edge 104 passes beyond sensor 190. A preferred distance is about 14", although other distances could be used. Upper plate 52 of edge guide 50 then drops down until it touches an upper surface of panel 100. Further movement of plate 52 compresses springs 169, until sensor 175 detects pad 177. Thereafter, upper plate 52 is raised upwardly away from lower plate 53 a predetermined distance, such as ⅛" to ¼" to a fixed position. This process permits edge guide 50 to measure the panel thickness and this value is stored in controller 90. Thereafter, edge guide 50 is backed outwardly away from table 110 a predetermined distance by motor 176. Controller 90 advances dolly 120 and sewing machine 20 toward table 110 and into a sew position in which the needles 22 are disposed in the desired stitching position. Clamp 44 is then opened to release edge 102.

By only using one clamp 43, the clamp closest to the sewing machine 20, panel 100 tends to be urged in a direction toward edge guide 50 to urge edge 106 into registration with plate 51. This process insures proper registration of edge 106 during the sewing process.

Figure 9:
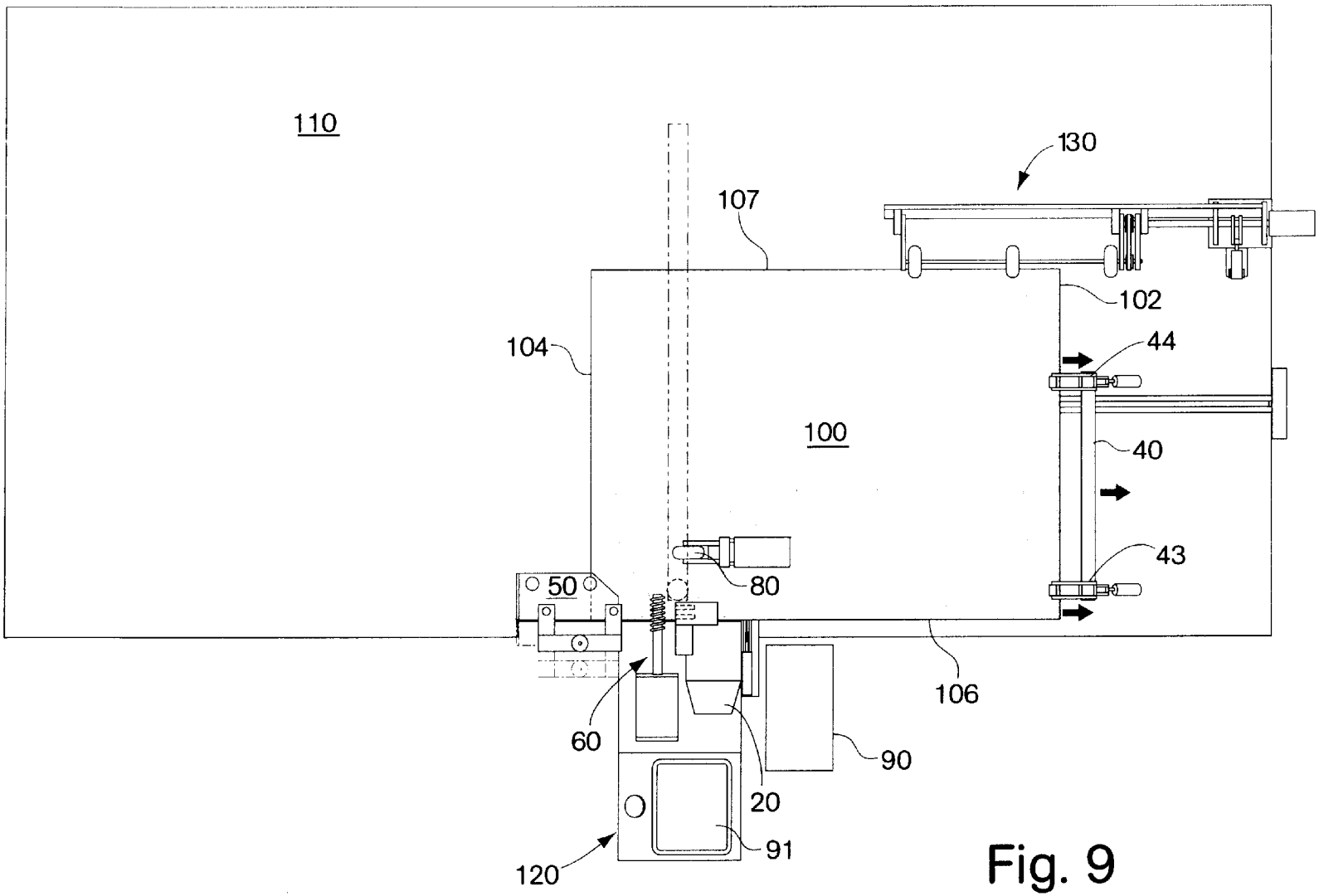
FIG. 9 is a top, schematic plan view of the apparatus of FIG. 1A illustrating another operating position.
Figure 10:
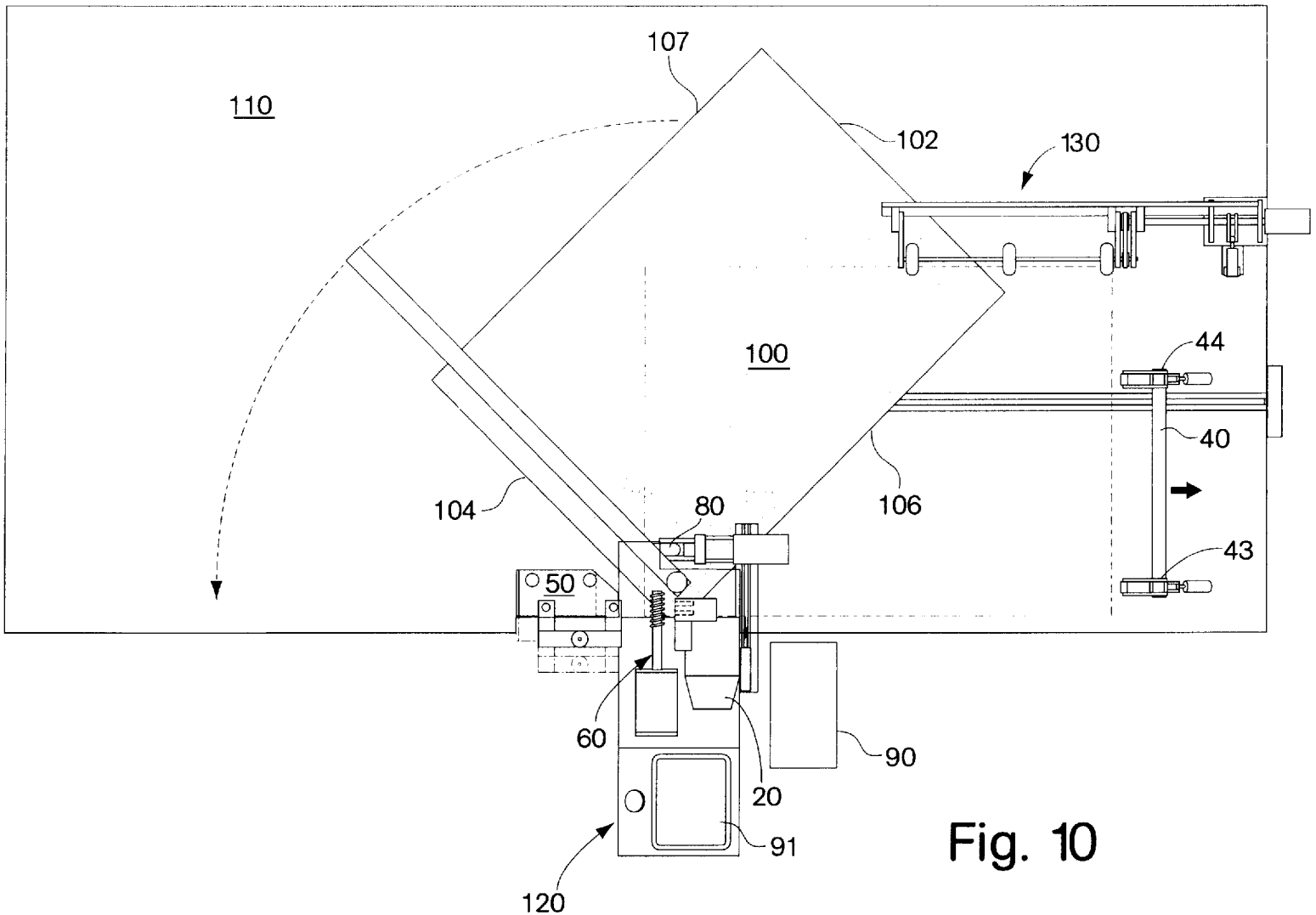
FIG. 10 is a top, schematic plan view of the apparatus of FIG. 1A illustrating rotation of the fabric panel.

If the panel 100 is properly oriented the process proceeds. If the panel is not properly oriented, controller 90 prompts the operator and the system returns to the load position and the process is repeated. Assuming that the panel is in its proper orientation, edge 106 is manually loaded by the operator into the sewing machine 20 beneath needles 22. The operator then pushes a "start" button on the touch screen or control point. This location is the start point. Thereafter, edge guide 50 is returned by motor 176 toward table 110 to the sew position in which plate 51 is aligned with edge 106. Upper plate 52 is dropped to the fixed position which was previously determined by the controller 90 as discussed aborts. The sewing needles and the feed elements of sewing machine 20 move into position. Sled 40 begins to pull panel 100 through sewing machine 20 to begin the stitching and cutting operation and slip clutch 131 is activated. The sewing head 22 then automatically sews a predetermined distance, such as 6", as measured by shaft encoder 135. The number of stitches is noted by controller 90 which determines the stitch rate for this panel. This stitch rate is required to determine the rate at which the panel should be rotated around each corner to maintain the same number of stitches per inch during rotation. As edge 104 passes sensor 57, the stitching rate is reduced to a slower stitching rate. This distance from sensor 57 to sewing needle 22 is typically about 6". Once edge 104 passes sensor 56, the sewing operation is stopped as shown in FIG. 9. Sensor 56 is spaced from sewing needle 22 a distance approximately equal to the point at which the turning operation should begin, or the tangent point of the radius of the corner which is to be formed between edges 104 and 106. This distance is, for example, about 4 inches from needles 22. Sewing needles 22 then stop. Pivot arm 30 drops, allowing projections 35 to engage the top surface of panel 100. Controller 90 causes pivot arm 30 to drop an amount that causes projections 35 to engage panel 100 without damaging the panel. Since controller 90 knows the thickness of panel 100, it spaces projections 35 from table 120 some pre-programmed amount, such as 50% of the panel thickness. Clamp 43 releases edge 102, and plate 52 rises upwardly. Arm 30 is then rotated by motor 31 through 90 degrees to rotate panel 100 around the corner between edges 104 and 106, as shown in FIG. 10.

The controller 90 knows the desired stitches per inch, and the speed of rotation of panel 100 is calculated to produce the same number of stitches per inch during the rotation. The length of the corner is equal to pi multiplied by the radius of the corner, and thus the distance to be stitched is known. Since the controller 90 knows this distance and knows the desired number of stitches per inch and the speed of the sewing machine, it can compute the rate of rotation required to produce the desired number of stitches per inch. Controller 90 also notes the stop position of sled 40 which provides information to controller 90 about the dimension of panel 100 between edge 104 and edge 102. During the rotation of panel 100, the sewing operation proceeds at a reduced speed, and cutter 25 continues to trim the edge of panel 100 to produce a rounded corner, and edge guide 50 is open to its full height so as not to impede rotation of panel 100. Also, during rotation, the speed of the edge flattener 60 is adjusted by controller 90 to provide the desired edge flattening effect on the corners to prevent wrinkles or radially extending redges. Typically, the speed of flattener 60 is increased over that employed when sewing the straight edges of the fabric panels.

Figure 11:
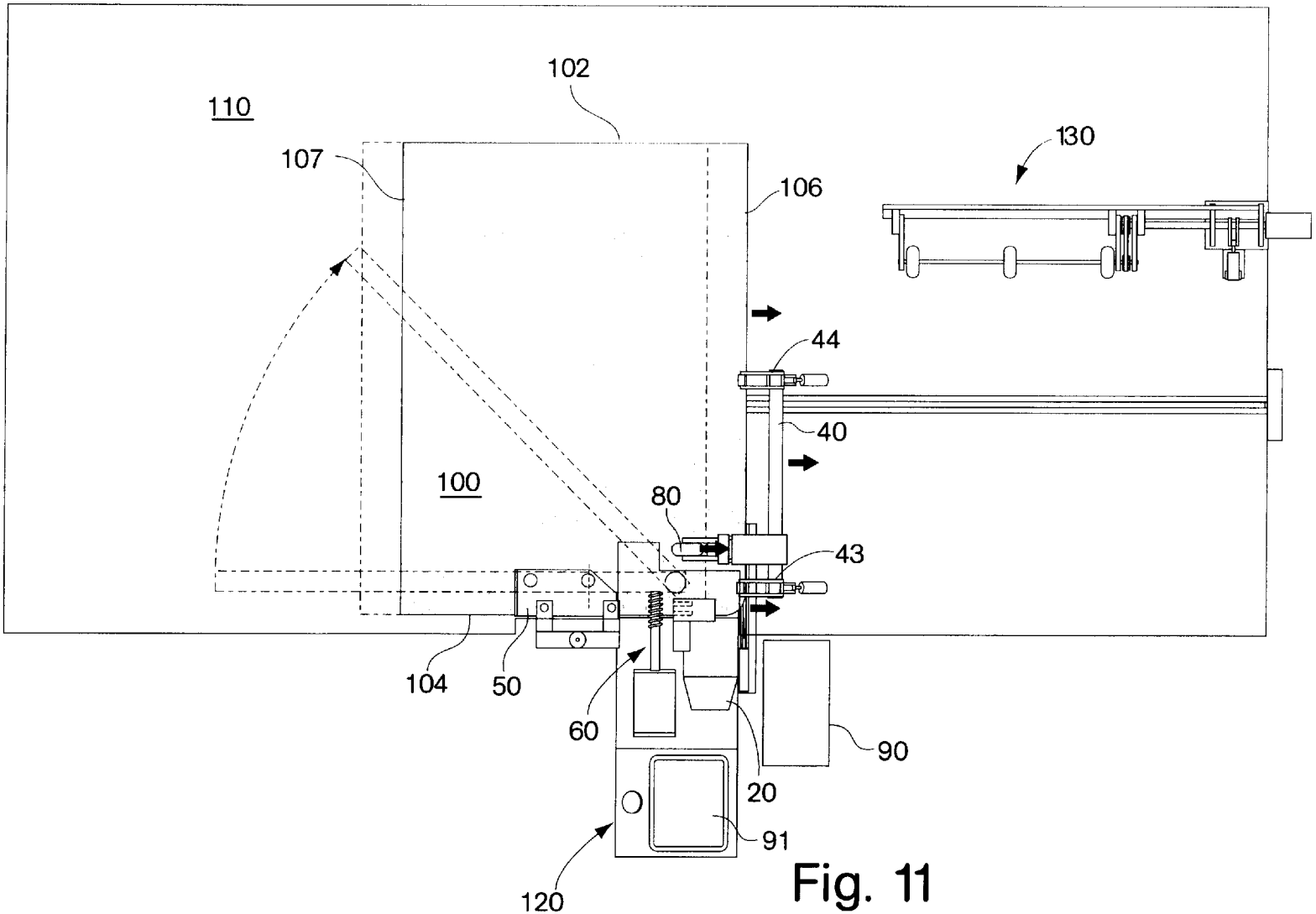
FIG. 11 is a top, schematic plan view of the apparatus of FIG. 1A illustrating a further operating position.

After this process has been completed, the sled returns to its home position in which clamps 43 and 44 are adjacent a new forward edge 102, and edge guide 150 returns to its fixed position for this particular panel as previously discussed, as shown in FIG. 11. At this point, only clamp 43 grasps edge 102. Arm 30 is raised off panel 100. Again, the slip clutch is activated and sewing restarts as sled 40 pulls a new edge 106 of panel 100 through sewing machine 20. The next corner is stitched in the same manner as the first corner, and the process is repeated until the final corner is reached. Since controller 90 knows the length of edges 106 and 107, if it is desired to stitch a label onto one of the edges, controller 90 can be programmed to stop at the middle of that edge to allow insertion of a label to be stitched by machine 20 as the flange material is attached.

Figure 12:
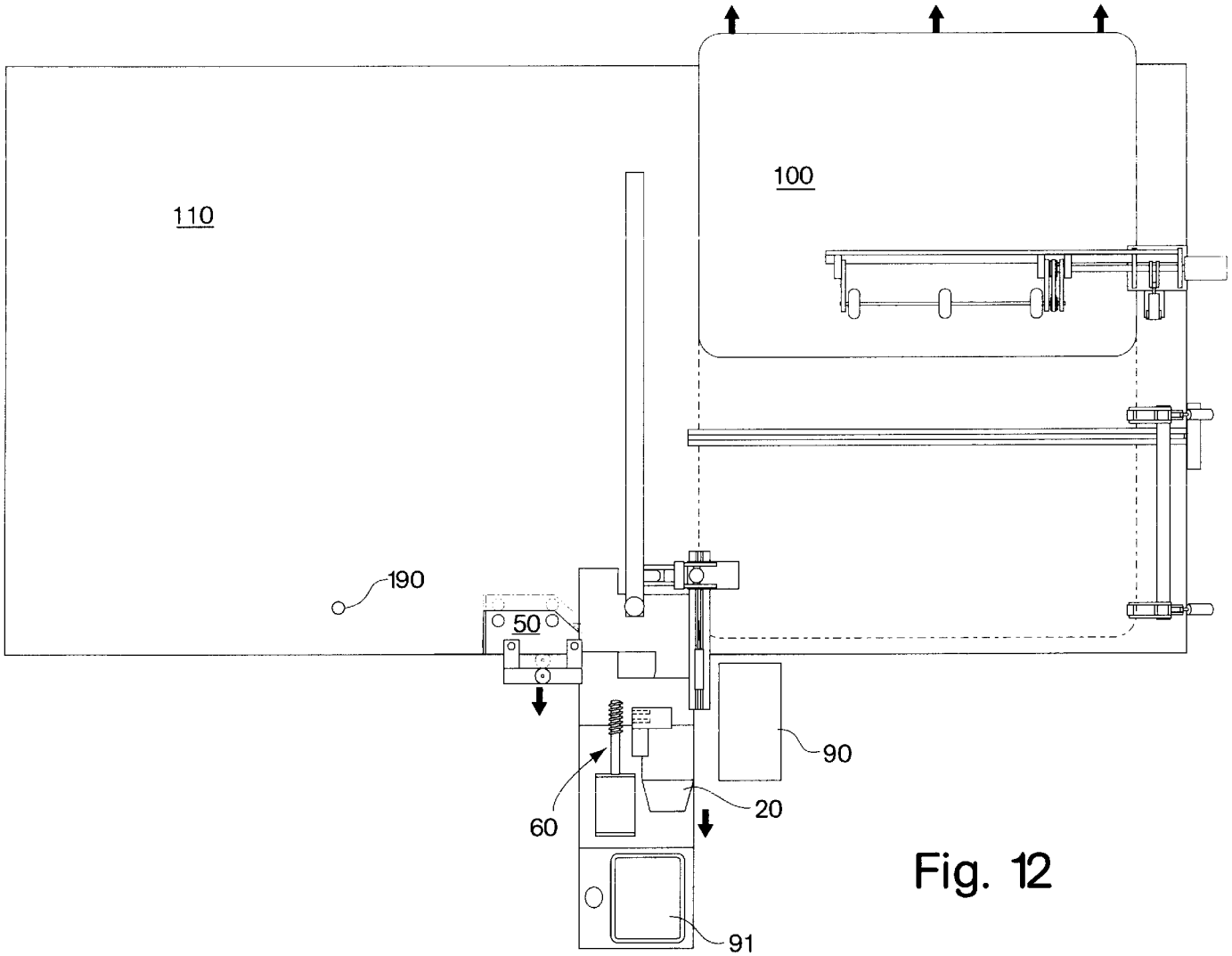
FIG. 12 is a top, schematic plan view of the apparatus of FIG. 1A illustrating a final operating position in which the fabric panel is removed from the apparatus.

As the fourth corner is approached, or the corner just prior to original edge 106, this corner is stitched like the others. Once the original edge 106 is in registration with edge guide 50, wheel 80 is extended by arm 82 and is dropped onto the upper surface of panel 100 by being pivoted about support 84. The wheel drop point is monitored by shaft encoder 135. Sewing machine 20 begins sewing and cutting along original edge 106 approaching the start point. As this step occurs, dolly 120 begins to back sewing machine 20 and flange guidance system 150 away from table 110, as illustrated by FIG. 12, so that by the time the start point is reached, the sewing needle has completely sewn off edge 106 and no longer performs any sewing operation on panel 100. At the same time, cutter 25 also is being withdrawn, so that at the time cutter 25 reaches the start point, no more material is being cut from the edge of panel 100. Thus, there is a smooth transition back to the start point providing a straight edge with the proper dimension. Sewing machine 20 continues to sew on the flange material. Since the dimension of panel 100 is known, when the final edge 104 passes by sewing machine 20, sled 40 is stopped. Cutter 70 is then activated to cut the flange material and the sewing threads along the back edge 104 of panel 100. The panel is then carried by sled 40 to a position at the far end of table 110 as shown by the dotted lines in FIG. 14. At this point, wheels 134 are pivoted into contact with panel 100 and are activated to propel panel 100 in a direction generally transverse to the feed direction 24 off table 110 or to the edge of table 110 remote from sewing machine 20 as shown in FIG. 12. Thereafter, sled 40 returns to the home position and the process is repeated for the next panel.

In view of the above description it is likely that modifications and improvements will occur to those skilled in the art, which should be deemed as being within the scope of this invention. The above description is intended to be exemplary only, the scope of the invention being defined by the following claims and their equivalents.

What is claimed is:

1. Apparatus for guiding fabric to a sewing machine, said apparatus being disposed prior to the sewing machine with respect to a direction of feed of the fabric to the sewing machine, said apparatus comprising:

an upper plate having a lower surface disposed above the fabric;

a lower plate having an upper surface disposed below the fabric and in spaced, confronting, generally parallel relation to said lower surface of said upper plate;

apparatus for selectively moving at least one of said lower and upper plates with respect to the other of said plates for adjusting a spacing between said upper surface of said lower plate and said lower surface of said upper plate for applying a clamping force to the fabric; and a sensor apparatus for automatically sensing when the clamping force on the fabric exceeds a predetermined amount and for automatically actuating said apparatus for selectively moving at least one of said lower and upper plates to move one of said lower and upper plates away from the other of said plates until reduction of the clamping force below the predetermined amount.

2. The apparatus as recited in claim 1 wherein said sensor apparatus comprises:

a structure for supporting said upper plate; and springs disposed between said support structure and said upper plate, said springs being compressed after said upper plate engages an upper surface of the fabric when said apparatus for selectively moving at least one of said lower and upper plates reduces the spacing between said upper surface of said lower plate and said lower surface of said upper plate.

3. The apparatus as recited in claim 2 wherein said sensor apparatus further comprises a sensor that senses compression of said springs greater than a predetermined amount.

4. The apparatus as recited in claim 1 further comprising a sensor for determining the spacing between said upper surface of said lower plate and said lower surface of said upper plate.

5. The apparatus as recited in claim 1 wherein said upper plate includes an edge facing away from the sewing machine in the feed direction which curves upwardly away from said lower plate.

6. The apparatus as recited in claim 1 further comprising at least one fabric edge position sensor disposed on said lower plate.

7. The apparatus as recited in claim 6 further comprising two spaced, fabric edge position sensors disposed on said lower plate.

8. The apparatus as recited in claim 7 further comprising openings disposed in said upper plate in vertical alignment with said fabric edge position sensors for allowing light from said edge position sensors to pass therethrough when there is no fabric disposed between said position sensors and said lower surface of said upper plate.

9. The apparatus as recited in claim 1 further comprising:

a sled disposed after the sewing machine in the feed direction;

at least one clamp disposed on said sled for grasping a forward edge of the fabric in the feed direction; and a drive system for moving said sled away from sewing machine in the feed direction to apply a pulling force to the fabric to pull the fabric past the sewing machine.

10. The apparatus as recited in claim 9 further comprising a slip clutch disposed between said drive system and said sled for controlling the amount of pulling force applied to the forward edge of the fabric.

11. Apparatus for sewing a strip of fabric to a fabric panel, said apparatus comprising:

a table for supporting the fabric panel;

a sewing machine disposed adjacent one edge of said table, said sewing machine receiving the strip of fabric and the fabric panel in a feed direction for sewing the strip of fabric to the fabric panel;

a dolly supporting said sewing machine, said dolly having an upper surface disposed prior to said sewing machine in the feed direction over which the fabric panel passes in the feed direction as it is advanced to the sewing machine, said upper surface having a slot disposed therein for receiving the strip of fabric therethrough;

a drive system for moving said dolly and said sewing machine toward and away from said table in a direction generally perpendicular to the feed direction;

a reel disposed on said dolly carrying a roll of the strip of fabric; and a feed passage extending from said reel to said slot on said upper surface for guiding the strip of fabric from the reel to said slot.

12. The apparatus as recited in claim 11 further comprising:

an arm pivotally mounted at one point on a support structure adjacent said sewing machine; and a wheel disposed on said arm at a point spaced from the point where said arm is pivotally mounted, said wheel being freely rotatable about an axis generally perpendicular to the feed direction, said arm being normally in a position in which said wheel is not in engagement with the fabric panel, said arm being pivotable about the support structure to place said wheel in engagement with the fabric panel to permit the fabric panel to move in the feed direction, but to prevent the fabric panel from moving in a direction perpendicular to the feed direction.

13. The apparatus as recited in claim 11 further comprising:

an arm disposed after the sewing machine in the feed direction;

an actuator for moving the arm in a direction generally perpendicular to the feed direction;

a slot disposed in said table below said arm and extending parallel to said arm; and a sharp edge disposed on said arm and riding in said slot, said sharp edge being moved in said slot by said actuator after passage of a trailing edge of the fabric panel across a path of travel of the fabric panel to cut threads from the sewing machine and a trailing portion of the strip of fabric.

14. Apparatus for sewing a fabric panel comprising:

a table for supporting the fabric panel;

a sewing machine for sewing the fabric panel and for moving the fabric panel in a feed direction; and apparatus for removing the fabric panel from the table after completion of a sewing operation, said removing apparatus comprising:

a plurality of wheels rotatably mounted on a support structure, said wheels being rotatable about an axis of rotation generally parallel to the feed direction; and a drive system for rotating said wheels about said axis of rotation such that portions of said wheels touching a top surfaces of a fabric panel move in a direction away from said sewing machine and in a direction generally perpendicular to the feed direction to remove the fabric panel from the table in a direction generally perpendicular to the feed direction.

15. The apparats as recited in claim 14 further comprising apparatus for pivoting the support structure about an axis to selectively raise said wheels away from said table and lower said wheels toward said table to engage an upper surface of the fabric panel.

16. Apparatus for sewing together a fabric panel which is filled with a material and a piece of fabric, said apparatus comprising:

a table for supporting the fabric panel, said table having a generally horizontal upper surface;

a sewing machine for receiving the fabric panel and piece of fabric in a feed direction and for joining together the fabric panel and the piece of fabric;

an edge flattener disposed prior to the sewing machine in the feed direction, the feed direction being generally parallel to said upper surface of said table adjacent said edge flattener, the edge flattener including a component rotatable about an axis of rotation for flattening the material in the fabric panel, a lower surface of said component of said edge flattener being structured to engage the fabric panel, the edge flattener rotating in a direction such that the lower surface of said component moves in a direction opposite of the feed direction; and a servo motor for rotating the component about its axis of rotation at a speed of rotation that is variable and controllable independently of the speed of the sewing machine.

17. A method for sewing an edge of a fabric panel comprising the steps of:

feeding the fabric panel to a sewing machine in a feed direction;

passing the edge of the fabric panel between an upper plate and a lower plate prior to the sewing machine in the feed direction, the upper plate and the lower plate being spaced from one another in generally parallel, confronting relation;

advancing a selected one of the upper plate and the lower plate toward the other of the upper plate and the lower plate until the upper and the lower plates sense the thickness of the fabric panel; and moving a selected one of the upper plate and the lower plate away from the other of the upper plate and the lower plate a predetermined distance sufficient to allow the edge of the fabric panel to pass between the upper and lower plate without significant drag on the fabric panel.

18. A method for sewing an edge of a fabric panel, said method comprising the steps of:

feeding an edge of the fabric panel to a sewing machine in a feed direction on a table;

during said feeding step, passing the edge of the fabric panel between two spaced plates;

reducing a spacing between the two plates until the spacing between the two plates is approximately equal to a thickness of the fabric panel;

measuring the thickness of the fabric panel by determining the spacing between the two plates;

sewing the edge of the fabric panel, said sewing step beginning at a start position; and rotating the fabric panel around a corner while continuing to sew the edge of the fabric panel, said rotating step including the step of lowering a rotating arm toward an upper surface of the fabric panel on the table for rotation of the fabric panel, so that the rotating arm is spaced from an upper surface of the table under the fabric panel a distance less than the thickness of the fabric panel as measured in said measuring step.

19. The method as recited in claim 18 further comprising the steps of:

flattening the edge of the fabric panel prior to said sewing step using an edge flattener rotating a first speed of rotation; and flattening the corner during said rotating step using the edge flattener rotating at a second speed of rotation greater than the first speed of rotation.

20. The method as recited in claim 18 further comprising the steps of:

moving the sewing machine away from the fabric panel in a direction generally perpendicular to the feed direction as the sewing machine approaches the start position; and engaging an upper surface of the fabric panel with a wheel which rotates freely about an axis generally perpendicular to the feed direction during said moving step.

21. Apparatus for guiding fabric to a sewing machine, said apparatus being disposed prior to the sewing machine with respect to a direction of feed of the fabric to the sewing machine, said apparatus comprising:

an upper plate having a lower surface disposed above the fabric;

a lower plate having an upper surface disposed below the fabric and in spaced, confronting, generally parallel relation to said lower surface of said upper plate;

apparatus for selectively moving at least one of said lower and upper plates with respect to the other of said plates for adjusting a spacing between said upper surface of said lower plate and said lower surface of said upper plate;

a structure for supporting said upper plate;

springs disposed between said support structure and said upper plate, said springs being compressed after said upper plate engages an upper surface of the fabric when said apparatus for selectively moving at least one of said lower and upper plates reduces the spacing between said upper surface of said lower plate and said lower surface of said upper plate; and a sensor that senses compression of said springs greater than a predetermined amount.

22. Apparatus for guiding fabric to a sewing machine, said apparatus being disposed prior to the sewing machine with respect to a direction of feed of the fabric to the sewing machine, said apparatus comprising:

an upper plate having a lower surface disposed above the fabric;

a lower plate having an upper surface disposed below the fabric and in spaced, confronting, generally parallel relation to said lower surface of said upper plate;

apparatus for selectively moving at least one of said lower and upper plates with respect to the other of said plates for adjusting a spacing between said upper surface of said lower plate and said lower surface of said upper plate; and at least one fabric edge position sensor disposed on said lower plate.

23. The apparatus as recited in claim 22 further comprising two spaced, fabric edge position sensors disposed on said lower plate.

24. The apparatus as recited in claim 22 further comprising at least one opening disposed in said upper plate in vertical alignment with said fabric edge position sensor for allowing light from said edge position sensor to pass therethrough when there is no fabric disposed between said position sensor and said lower surface of said upper plate.

25. Apparatus for guiding fabric to a sewing machine, said apparatus being disposed prior to the sewing machine with respect to a direction of feed of the fabric to the sewing machine, said apparatus comprising:

an upper plate having a lower surface disposed above the fabric;

a lower plate having an upper surface disposed below the fabric and in spaced, confronting, generally parallel relation to said lower surface of said upper plate;

apparatus for selectively moving at least one of said lower and upper plates with respect to the other of said plates for adjusting a spacing between said upper surface of said lower plate and said lower surface of said upper plate;

a sled disposed after the sewing machine in the feed direction;

at least one clamp disposed on said sled for grasping a forward edge of the fabric in the feed direction; and a drive system for moving said sled away from said sewing machine in the feed direction to apply a pulling force to the fabric to pull the fabric past the sewing machine.

26. The apparatus as recited in claim 25 further comprising a slip clutch disposed between said drive system and said sled for controlling the amount of pulling force applied to the forward edge of the fabric.

27. Apparatus for sewing a fabric panel, said apparatus comprising:

a table for supporting the fabric panel;

a sewing machine disposed adjacent one edge of said table, said sewing machine receiving the fabric panel in a feed direction for sewing the fabric panel;

an arm pivotally mounted at one point on a support structure adjacent said sewing machine; and a wheel disposed on said arm at a point spaced from the point where said arm is pivotally mounted, said wheel being freely rotatable about an axis generally perpendicular to the feed direction, said arm being pivotable about the support structure to place said wheel in engagement with the fabric panel to permit the fabric panel to move in the feed direction, but to prevent the fabric panel from moving in a direction generally perpendicular to the feed direction.

28. Apparatus for sewing a strip of fabric to a fabric panel, said apparatus comprising:

a table for supporting the fabric panel;

a sewing machine disposed adjacent one edge of said table, said sewing machine receiving the strip of fabric and the fabric panel in a feed direction for sewing the strip of fabric to the fabric panel;

an arm disposed after the sewing machine in the feed direction;

an actuator for moving the arm in a direction generally perpendicular to the feed direction;

a slot disposed in said table below said arm and extending parallel to said arm; and a sharp edge disposed on said arm and riding in said slot, said sharp edge being moved in said slot by said actuator after passage of a trailing edge of the fabric panel across a path of travel of the fabric panel to cut threads from the sewing machine and a trailing portion of the strip of fabric.

29. A method for sewing a strip of material to the edge of a fabric panel, said method comprising the steps of:

feeding an edge of the fabric panel to a sewing machine in a feed direction;

feeding a strip of material to the sewing machine in the feed direction such that one edge of the material is aligned with the edge of the fabric panel;

sewing the strip of material to the edge of the fabric panel;

after completion of said sewing step, pulling the fabric panel free of the sewing machine; and after the fabric panel is free of the sewing machine, cutting the strip of material and the sewing threads in a single cutting operation.

30. A method for sewing an edge of a fabric panel, said method comprising the steps of:

feeding an edge of the fabric panel to a sewing machine in a feed direction on a table;

sewing the edge of the fabric panel;

rotating the fabric panel around a corner while continuing to sew the edge of the fabric panel;

flattening the edge of the fabric panel prior to said sewing step using an edge flattener rotating at a first speed of rotation; and flattening the corner of the fabric panel during said rotating step using the edge flattener rotating at a second speed of rotation greater than the first speed of rotation.

31. A method for sewing a fabric panel, said method comprising the steps of:

feeding the fabric panel to a sewing machine in a feed direction;

sewing the fabric panel, said sewing step beginning at a start position;

rotating the fabric panel around a corner;

moving the sewing machine away from the fabric panel in a direction generally perpendicular to the feed direction as the sewing machine approaches the start position; and engaging an upper surface of the fabric panel with a wheel which rotates freely about an axis generally perpendicular to the feed direction during said moving step.

* * * * *